US007537532B2

(12) United States Patent
Young

(10) Patent No.: US 7,537,532 B2
(45) Date of Patent: May 26, 2009

(54) HANDLE FOR IMPLEMENT AND METHOD

(76) Inventor: Carl D. Young, 4921 Longwood Ct., Irving, TX (US) 75038

( * ) Notice: Subject to any disclaimer, the term of this patent is extended or adjusted under 35 U.S.C. 154(b) by 35 days.

(21) Appl. No.: 11/748,700

(22) Filed: May 16, 2007

(65) Prior Publication Data

US 2008/0282853 A1 Nov. 20, 2008

(51) Int. Cl.

| | |
|---|---|
| ***A63B 59/06*** | (2006.01) |
| ***A63B 53/14*** | (2006.01) |
| ***A63B 49/08*** | (2006.01) |
| ***B25G 1/00*** | (2006.01) |

(52) U.S. Cl. ..... 473/568; 473/549; 473/303; 81/489

(58) Field of Classification Search ..... 473/457, 473/519, 520, 558–568, 300–303, 549–552, 473/513, 527, 294, 251; 81/20, 22, 489; 16/430; 74/551.9

See application file for complete search history.

(56) References Cited

U.S. PATENT DOCUMENTS

| | | | | |
|---|---|---|---|---|
| 346,858 | A * | 8/1886 | Moss | 473/551 |
| 1,296,416 | A | 3/1919 | Maddox | |
| 1,449,677 | A | 3/1923 | Jones | |
| 1,919,221 | A * | 7/1933 | Janes | 473/294 |
| 2,536,607 | A | 1/1951 | Jenkins | |
| 2,800,680 | A | 7/1957 | Galvin | |
| 3,459,426 | A * | 8/1969 | Aaron | 473/201 |
| 4,215,860 | A * | 8/1980 | Nakamatsu | 473/201 |
| 5,034,082 | A * | 7/1991 | Nolan | 156/245 |
| 5,308,073 | A | 5/1994 | McKoon et al. | |
| 5,368,298 | A | 11/1994 | You | |
| 5,553,858 | A | 9/1996 | McKoon et al. | |
| 5,647,806 | A * | 7/1997 | McDevitt | 473/252 |
| 5,868,631 | A * | 2/1999 | Palonen | 473/203 |
| 5,944,617 | A * | 8/1999 | Falone et al. | 473/300 |
| 5,951,418 | A | 9/1999 | Atkinson | |
| 6,071,199 | A * | 6/2000 | Suzuki | 473/294 |
| 6,302,812 | B1 | 10/2001 | Perry | |
| 6,358,165 | B1 | 3/2002 | Davis | |
| 6,440,016 | B1 | 8/2002 | Chang | |
| 6,875,125 | B1 | 4/2005 | Federowicz | |
| 6,935,975 | B2 * | 8/2005 | Chang et al. | 473/549 |
| 2003/0114240 | A1 * | 6/2003 | Lacoste | 473/294 |
| 2004/0087395 | A1 | 5/2004 | Manory | |
| 2007/0232420 | A1 * | 10/2007 | Esquerra | 473/451 |

* cited by examiner

*Primary Examiner*—Mark S Graham
(74) *Attorney, Agent, or Firm*—Grady K. Bergen; Griggs Bergen LLP

(57) ABSTRACT

An implement for swinging in one's hands has an implement body. A handle extends from the implement body. The handle consists of two elongate handle members that generally abut against the other along substantially the length of the handle members. The handle members have inwardly sloped, converging sidewalls along at least one side of the handle where the handle members abut to form a longitudinal groove along substantially the length of the at least one side of the handle. The converging sidewalls are at least one of convex arcuate or planar surfaces. A method of swinging the implement may be performed by gripping the handle with both hands so that the hands are in a closely adjacent or touching adjacent position with at least the tip of one or more fingers lie generally in or along the longitudinal groove. The implement is then swung while holding the implement in both hands.

20 Claims, 3 Drawing Sheets

HANDLE FOR IMPLEMENT AND METHOD

BACKGROUND

This invention relates to implements that are swung in the hand or hands, and in particular, to handles for and methods of swinging such implements.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 1:
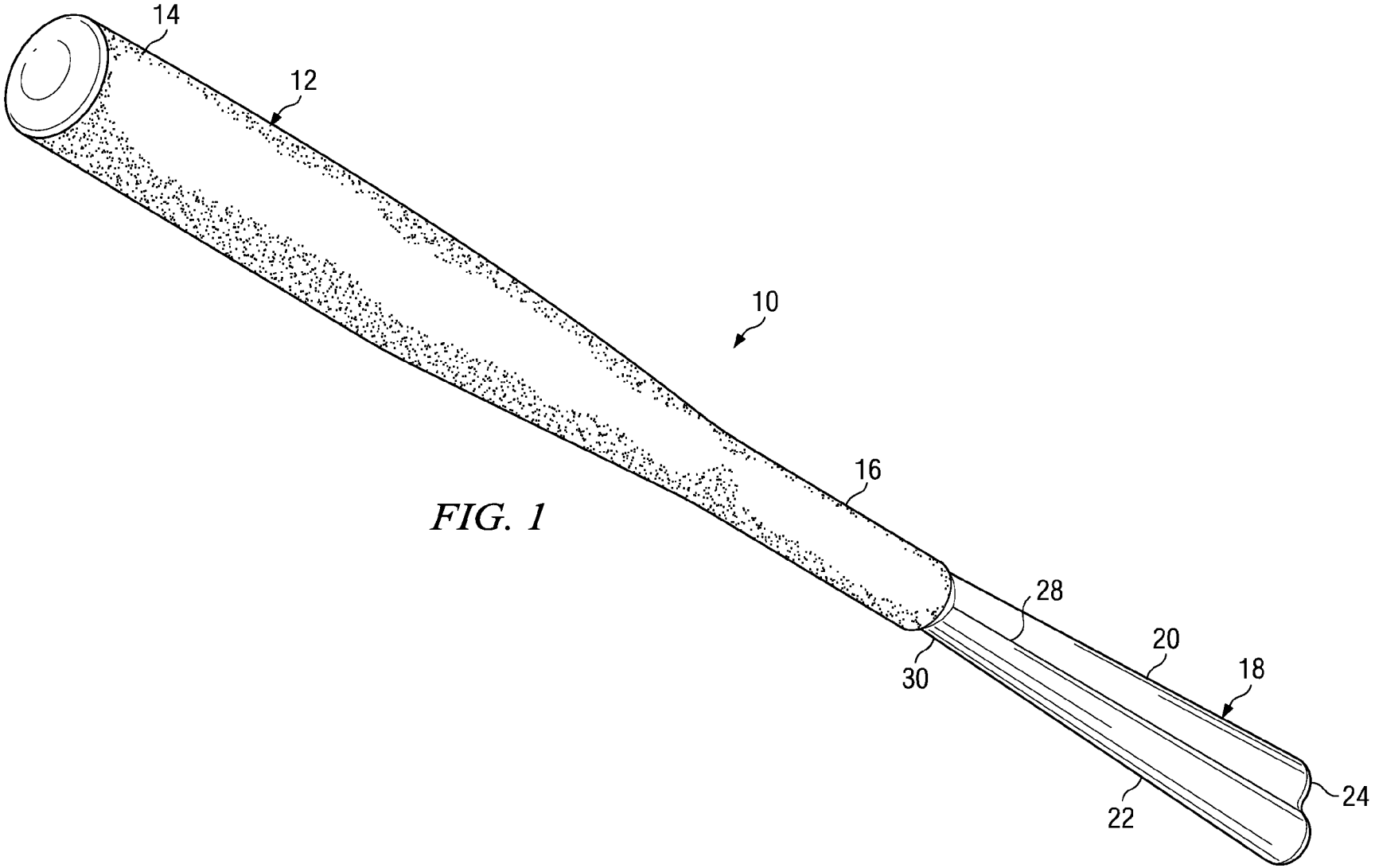
FIG. 1 is a perspective view of a baseball bat constructed in accordance with the invention.

Referring to FIG. 1, a bat 10 such as is used in baseball, softball and the like, is shown. The bat 10 includes an elongated, generally cylindrical body or barrel portion 12, which is used for striking a ball (not shown) during swinging of the bat 10. The distal end 14 of the barrel portion 12 has a width or diameter that is greater than the proximal end 16. As shown, the diameter of the barrel 12 decreases or tapers gradually toward the proximal end 16. Extending from the proximal end 16 of the body 12 is a handle 18.

It should be understood that although a bat 10 is shown and described, this is merely a representation of one particular swinging implement for which the handle 18 shown and described herein may be used. Other swinging implements, such as various sporting equipment and handheld tools (e.g. golf clubs, tennis and other rackets, axes, sledge hammers, carpenter hammers, etc.) may also be encompassed by the swinging implement of the invention, as well. The implement and its handle may be formed from a variety of different materials including, but not limited to, wood, metal, plastic, fiberglass, graphite, various composite materials, etc. All or a portion of the implement and/or implement handle may be hollow or solid in construction.

As shown in FIG. 1, the handle 18 extends from the proximal end 16 of the bat body 12. The handle 18 may have a longitudinal axis that is generally coaxial or parallel with a longitudinal axis of the bat body 12. The handle 18 is formed from two elongate handle members 20, 22, which are in a generally abutting or stacked relationship along substantially the entire length of the handle members. As used herein, the expression "abutting," "abut" or "stacked" with reference to the handle members 20, 22, is meant to encompass the situation where the handle members are actually touching or are in a near touching relationship. It is also meant to encompass the situation wherein the handle members 20, 22 are actually joined together and may be formed as an integral unit. When in a near touching relationship, a very slight gap or gaps (e.g. 1-2 mm or less) may exist between the handle members 20, 22.

When a range is presented herein as an example, or as being useful, suitable, etc., it is intended that any and every amount or point within the range, including the end points, is to be considered as having been stated. Furthermore, when the modifier "about" is used with reference to a range or numerical value, it should also be alternately read as to not include this modifier, and when the modifier "about" is not used with reference to a range or numerical value, the range or value should be alternately read as including the modifier "about."

Each handle member 20, 22 may have a uniform height and width along its length. Each handle member 20, 22 may be generally in the shape of a singular handle itself. Alternatively, the handle members 20, 22 may decrease in width and/or height along the length of the handle 18 from the end of the handle 24 towards the proximal end 16 of the body 12. As used herein, "width" is used to describe the horizontal dimension and "height" is used to describe the vertical dimension, as shown when the handle is oriented in the position shown in FIGS. 3 and 4.

Figure 4:
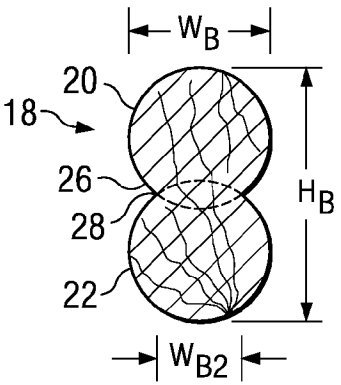
FIG. 4 is a transverse cross-sectional view of the handle of FIG. 2 taken along the lines 4-4.
Figure 3:
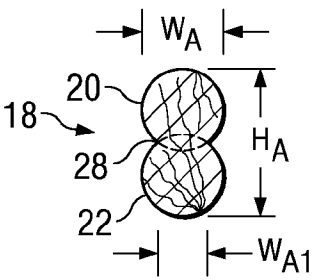
FIG. 3 is a transverse cross-sectional view of the handle of FIG. 2 taken along the lines 3-3.

In the particular embodiment shown, each handle member 20, 22 has a generally frusto-conical shape so that each handle member 20, 22 may have a generally circular transverse cross section, as can be more readily seen in FIGS. 3 and 4, such those that may be used on a conventional golf club. The handle members 20, 22 may be the same or similar to the other in size and shape.

In the embodiment shown, the handle members 20, 22 are integrally formed together and configured so that they are joined lengthwise along one side. As can be seen in the embodiment of FIGS. 3 and 4, the handle members 20, 22 are joined together so that there is a slight overlap of the circular cross sections on one side along the length of the handle 18. The height of the overlap may be, for example, ¼ inch or less, is employed, but is at least small enough to provide the inwardly converging sidewalls, as discussed more fully below. For handle members having generally the same size circular transverse cross sections, a suitable overlap may be represented by the following formula:

$$W=K\times W_1 \tag{1}$$

where,

W is the diameter of the handle member circular cross section, $W_1$ is the chord length of the intersecting cross sections at the center of the overlap; and K=1.7 or more.

The height of overlap may be represented by the formula:

$$\text{Overlap Height}=W/2-\text{sqrt}[4(W/2)^2+W_1^2] \tag{2}$$

The overlap may be very slight or eliminated entirely. Indeed, as discussed earlier, a slight gap may even exist between the abutting handle members. In such cases where a slight gap exists or a where there is no overlapping portions to the cross sections a bridging portion or portions may be used to join the handle members together.

Although the dimensions of the handle may vary, as an example, the handle member may have a width of from about 0.75 to about 1.5 inches at the wider end and from about 0.5 to about 0.75 inches at the narrower end. The variation in width W of each handle member may be linear and represented by $M_w$ having a value of from about 0.02 to about 0.15 where $M_w=|W_A-W_B|/L$, where $W_A$ is the width of the handle member at a first position and $W_B$ is the width of the handle at a second position located at a distance L from the first position the handle member.

Similarly, the total height of the handle 18 H formed by the handle members 20, 22 may decrease along the length of the handle 18 from the end 24 of the handle 18 towards the proximal end 16 of the body 12. Although the dimensions of the handle may vary, as an example, the handle may have a height of from about 1.5 to about 3 inches at the wider end and from about 1.0 to about 1.5 inches at the narrower end. The height of the handle formed by the collective height of the handle members 20, 22, may be greater than the width of the handle. In certain embodiments, the height of the handle will be approximately twice the width, although this may vary depending upon the configuration of the handle members used. The variation in height of the handle 18 may also be linear and represented by $M_H$ having a value of from about 0.04 to about 0.3 where $M_H=|H_A-H_B|/L$, where $H_A$ is the height of the handle at a first position and $H_B$ is the height of the handle at a second position located at a distance L from the first position.

Figure 2:
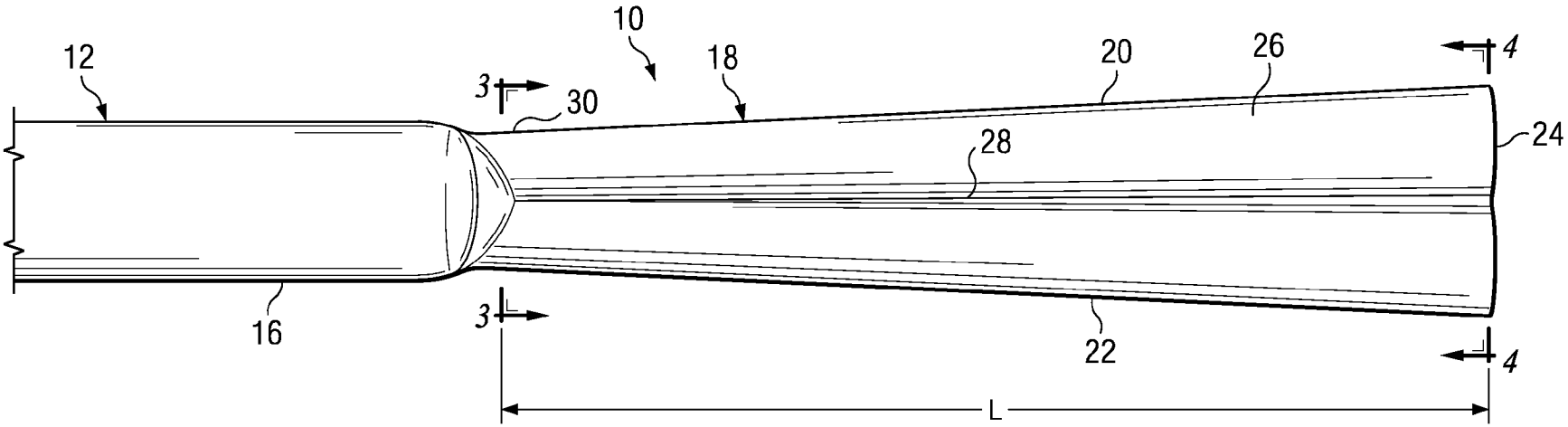
FIG. 2 is a side elevational view of the handle of the bat of FIG. 1.

Because of the configuration of each handle member 20, 22, the handle members 20, 22 have converging sidewalls having inwardly sloped, converging, convex arcuate surfaces where the handle members generally abut one another to form a longitudinal groove 28 on each side of the handle 18, as can be seen in FIG. 2. The groove 28 may extend substantially along the entire length of the handle 18 and may generally bisect the side of the handle 18. In certain embodiments, the handle 18 may be configured so that the groove 28 is formed on only one side of the handle 18. This may be accomplished by providing inwardly converging sidewalls of the handle members on only one side of the members 20, 22. The opposite side of the handle members 20, 22 may be flush or otherwise configured without a longitudinal groove.

Figure 5:
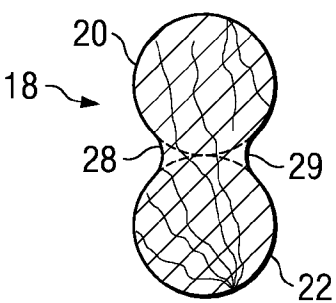
FIG. 5 is a transverse cross-sectional view of a handle wherein handle members of the handle do not overlap.

FIG. 5 shows a cross section of the handle 18 employing no overlap of the circular cross sections of the abutting handle members 20, 22. As can be seen, the longitudinal groove 28 may have a slight arcuate concave bridging portion 29 at the point where the side walls of the handle members 20, 22 intersect. This small concave portion may also be present at the convergence point of the inwardly converging sidewalls for overlapping handle members of FIGS. 3 and 4, as well. The small concave portion where the walls of the side walls of the handle members 20, 22 converge may facilitate transitioning of the area between the handle members 20, 22. The height of this slight concavity is significantly less than that formed by the inwardly converging convex sidewall portions.

The length of the handle 18 may vary depending upon the size of the hands of the user, with handles for children being smaller and those for adults being larger. The length of the handle relative to the entire length of implement may also vary. As an example, however, the length of the handle may be from 20 to 40% of the total length of the implement for which it is used. For a baseball or softball bat, the handle may have a length of approximately 30% of the total length of the bat. The handle may be long enough so that the user may grasp the handle in both hands, with the hands positioned in a touching or closely adjacent position. In certain cases, the hands may be slightly overlapping. There may also exist a situation where the handle is configured and/or sized to be held in one hand, as for example, if it were employed in carpenter's hammer. The distal end 30 of the handle 18 adjacent the proximal end 16 of implement body 12 may not taper as significantly or be constant in dimension to facilitate convergence with the implement body 12. Additionally, the distal end 30 of the handle may actually flare or increase in dimension to facilitate a smooth or suitable convergence with the implement body 12.

An example of dimensions for a 10 inch handle formed by frusto-conical handle members, such as shown in FIGS. 1-4, is set forth in Table 1 below.

TABLE 1

| Distance from Handle End (inches) | Handle height (inches) | Width (inches) |
|---|---|---|
| 0 | 2.156 | 1.078 |
| 2 | 1.906 | 0.953 |
| 4 | 1.813 | 0.906 |
| 6 | 1.656 | 0.828 |
| 7.5 | 1.563 | 0.781 |
| 10 | 1.500 | 0.750 |

In use, the user may grasp the handle 18 so that the hands are in a closely adjacent or touching adjacent position, with at least the tip of one or more fingers lying generally in or along the longitudinal groove. Although the handle may be held in variety of ways, one manner of holding the handle 18 is shown generally in FIG. 6, which may be used for swinging a baseball bat or other objects incorporating the handle. In this manner, the lead hand (i.e. the hand (backhand) located towards the direction of forward swing) is placed near the proximal end 24 of the handle 18. The top side or width of the handle 18 may be positioned generally in the V formed between the thumb and index finger of the lead hand, with the side or height of the handle 18 generally extending across the palm of the hand. The fingers of the lead hand may curl around the handle so that the tips of the fingers generally rest along the groove 28 on the trailing side of the handle 18.

Figure 6:
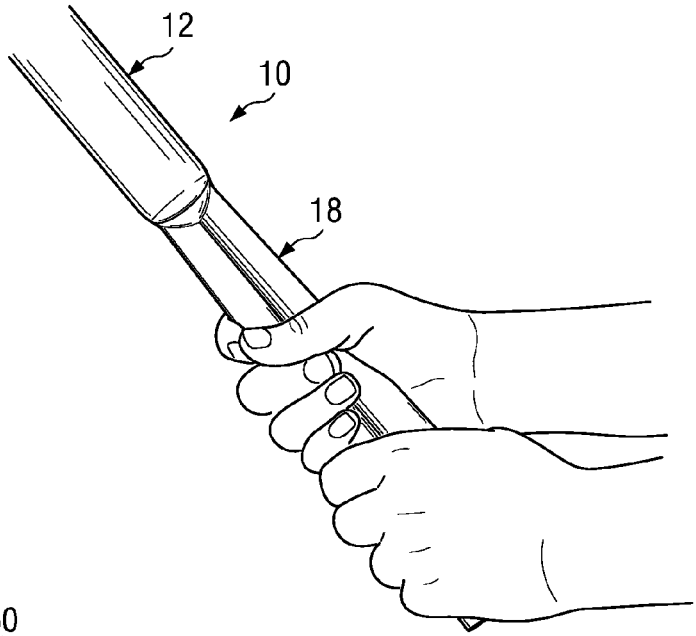
FIG. 6 is a perspective view of the baseball bat of FIG. 1, shown being held in a user's hands in accordance with the invention.

The trailing hand is positioned above or forward of and closely adjacent to the lead hand, as shown in FIG. 6, and may be in a touching relationship. The top side of the handle 18 may also be positioned generally in the V formed between the thumb and index finger of the trailing hand, with the side of the handle 18 extending across the palm of the hand and the fingers of the trailing hand curling around the handle so that the tips of the fingers generally rest along the groove 28 on the lead side of the handle 18.

Because of the unique configuration, the handle causes the user to grip the handle with the fingers extended with a more open palm, as opposed to a closed palm grip. This provides the user with more control and power and also causes the user to align the fingers and wrist for better performance using the forearm muscles and hand strength of the user. It also causes the user to use a different combination of forearm muscles than is used with a more conventional circular handle.

Figure 7:
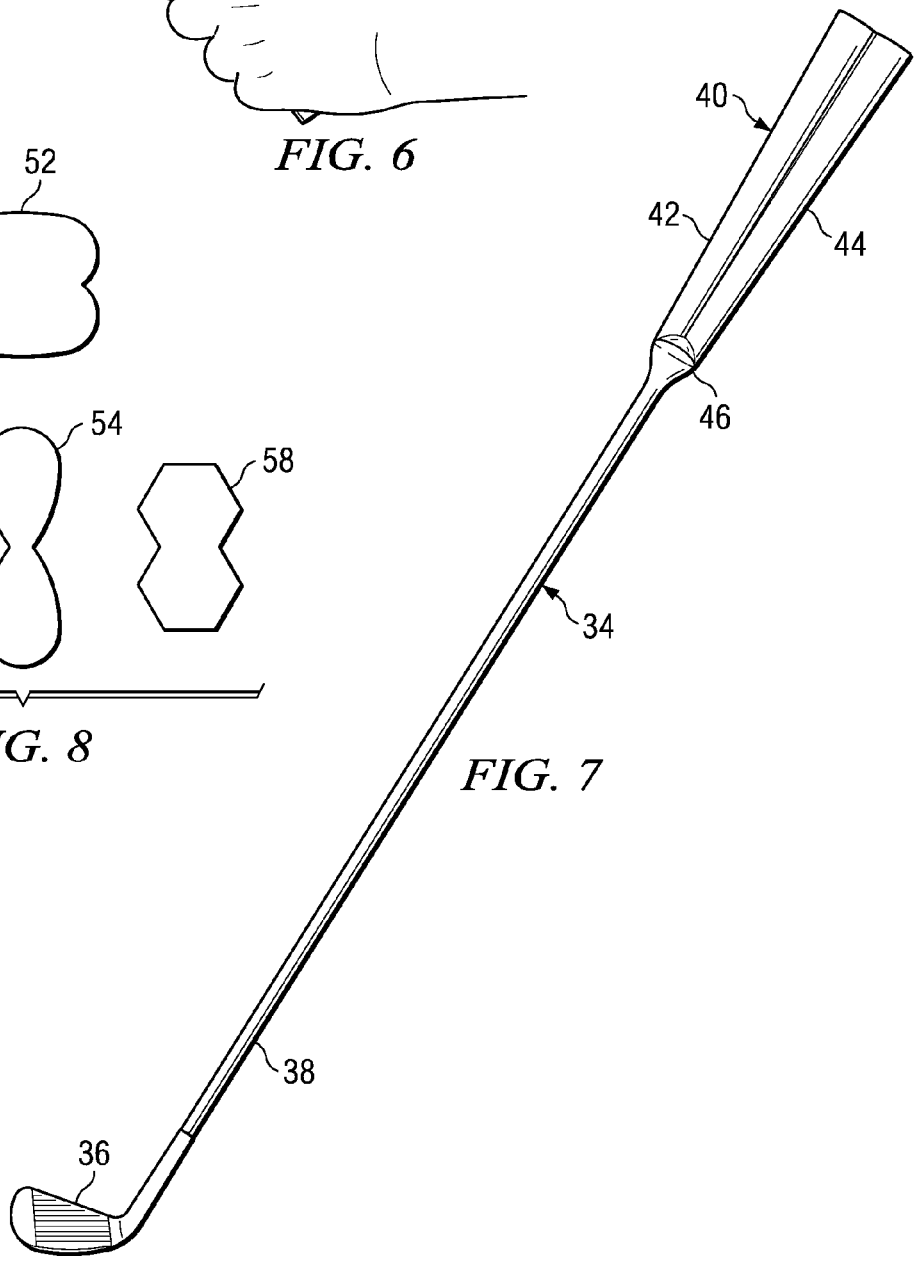
FIG. 7 is side elevational view of a golf club constructed in accordance with the invention.

FIG. 7 shows a golf club 34 having a head 36 and a shaft 38. A handle 40, which is similar in construction to the handle 18, is coupled to the shaft 38. The handle 40 also employs handle members 42, 44, which are similar in construction to the handle members 20, 22, previously described. In this embodiment, the distal end 46 of the handle 40 decreases in dimension to facilitate a smooth or suitable convergence with the shaft 38 of the golf club 34. As can be seen, the handle 40 of the golf club 34 is oriented relative to the club head 36 so that during the golf swing the side or height of the handle 40 is oriented generally perpendicular to the direction of the swing or may be slightly skewed from perpendicular in either direction, as may be preferred by the user. The grip used may be similar to that shown in FIG. 6 for holding the bat, wherein the hands are positioned adjacent and one over the other. The grip may be modified, however, to that commonly employed for gripping a golf club, including overlapping or interlocking of one or more of the fingers.

Figure 8:
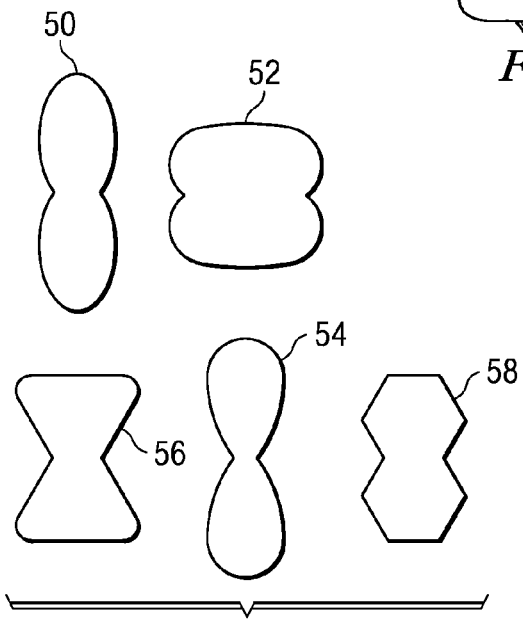
FIG. 8 is a transverse cross-sectional view of various embodiments of handles constructed in accordance with the invention.

FIG. 8 shows various other transverse cross-sectional configurations for handles constructed in accordance with the invention. In addition to circular transverse cross sections for the handle members, the handle members may have other arcuate shapes, such as an oval-, pear- or tear-shaped transverse cross sections, as represented at 50, 52 and 54. The handle members may also have polygonal transverse cross sections, wherein planar sidewalls of the handle members provide inwardly sloped, converging planar surfaces to thus form the longitudinal groove along the side or sides of the handle. Examples of such polygonal shapes include handles having handle members with transverse cross-sections that are triangular and hexagonal in shape, as shown at 56 and 58. A combination of these shapes may also be employed, with the handle members employing a portion of the polygonal or arcuate shapes. Thus, one side of the handle may employ polygonal shapes, with planar converging sidewalls, and the opposite side of the handle may employ arcuate converging sidewalls. Likewise, the upper or lower handle members may be different. For example, one of the upper or lower handle members may be configured to provide convex arcuate sidewalls, and the other handle member may be configured to provide a planar side wall that converges with the arcuate sidewall of the other handle member to form the longitudinal groove.

The surface of the handle of the implement may be provided with ribbed grooves, texturized or otherwise surface treated, such as with a rubber coating or rubber with grit additive coatings, and the like, to enhance the feel and grip of the handle. All or a portion of the implement and the implement handle may be hollow or be solid in construction. The handle may be incorporated with the implement itself or may be retrofitted to the implement.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim:

1. An implement for swinging in one's hands comprising:
an implement body;
a handle extending from the implement body, the handle consisting of two elongate handle members that generally abut against the other along substantially the length of the handle members, the handle members having inwardly sloped, converging sidewalls along each side of the handle where the handle members abut to form a single longitudinal groove along substantially the length of each side of the handle that generally bisects the side of the handle, the converging sidewalls being at least one of convex arcuate or planar surfaces, and wherein the handle has a variation in height represented by $M_H$ having a value of from about 0.04 to about 0.3 where $M_H=|H_A-H_B|/L$, where $H_A$ is the height of the handle at a first position and $H_B$ is the height of the handle at a second position located at a distance L from the first position, the handle members each decreasing in width and height along the length of each member towards the implement body.

2. The implement of claim 1, wherein:
a bridging portion is used to join the handle members together.

3. The implement of claim 1, wherein:
the handle members have a transverse cross-sectional shape that is one of generally a circle, an oval, a triangle, a pear or tear shape, a hexagon and a polygon.

4. The implement of claim 1, wherein:
the handle members are similar in size and shape.

5. The implement of claim 1, wherein:
the height of the handle is greater than the width.

6. The implement of claim 1, wherein:
the handle has a length that is from about 20% to 40% of the total length of the implement.

7. The implement of claim 1, wherein:
each handle member has a generally frusto-conical shape.

8. The implement of claim 1, wherein:
the implement is a bat, golf club, racket, hammer or axe.

9. The implement of claim 1, wherein:
a slight gap exists between the handle members.

10. An implement for swinging in one's hands comprising:
an implement body;
a handle extending from the implement body, the handle consisting of two elongate handle members that generally abut against the other along substantially the length of the handle members, the handle members having inwardly sloped, converging sidewalls along each side of the handle where the handle members abut to form a single longitudinal groove along substantially the length of each side of the handle that generally bisects the side of the handle, the converging sidewalls being at least one of convex arcuate or planar surfaces, and wherein the handle has a variation in height represented by $M_H$ having a value of from about 0.04 to about 0.3 where $M_H=|H_A-H_B|/L$, where $H_A$ is the height of the handle at a first position and $H_B$ is the height of the handle at a second position located at a distance L from the first position, each handle member having a generally frusto-conical shape.

11. The implement of claim 10, wherein:
a slight gap exists between the handle members.

12. The implement of claim 10, wherein:
the handle members each decrease in height and width along the length of each member towards the implement body.

13. The implement of claim 10, wherein:
the handle has a height of from about 1.5 to about 3 inches at the wider end and from about 1.0 to about 1.5 inches at the narrower end.

14. The implement of claim 10, wherein:
the handle members are similar in size and shape.

15. The implement of claim 10, wherein:
the height of the handle is greater than the width.

16. The implement of claim 10, wherein:
the implement is a bat, golf club, racket, hammer or axe.

17. The implement of claim 10, wherein:
the handle has a length that is from about 20% to 40% of the total length of the implement.

18. The implement of claim 10, wherein:
each handle member has a circular cross section and wherein there is a slight overlap of the circular cross sections of each handle member.

19. The implement of claim 18, wherein:
the overlap is represented by the following formula:

$$W=K\times W_1$$

where,
W is the diameter of the handle member circular cross section at a given point along the handle,
$W_1$ is the chord length of the intersecting cross sections at the center of the overlap; and
K=1.7 or more.

20. The implement of claim 10, wherein:
a bridging portion is used to join the handle members together.

* * * * *